United States Patent [19]

Suzuki et al.

[11] 4,112,867

[45] Sep. 12, 1978

[54] APPARATUS FOR CONTROLLING THE TONER CONCENTRATION OF A DEVELOPER USED IN A DRY TYPE DEVELOPING SYSTEM

[75] Inventors: Koichi Suzuki; Shigeru Suzuki; Minoru Suzuki, all of Yokohama, Japan

[73] Assignee: Ricoh Company, Ltd., Japan

[21] Appl. No.: 771,732

[22] Filed: Feb. 24, 1977

Related U.S. Application Data

[63] Continuation of Ser. No. 587,660, Jun. 17, 1975, abandoned.

[30] Foreign Application Priority Data

Jun. 18, 1974 [JP] Japan ..... 49-69335
Jun. 19, 1974 [JP] Japan ..... 49-69854

[51] Int. Cl.[2] ..... G03G 15/09
[52] U.S. Cl. ..... 118/7; 118/646; 427/18
[58] Field of Search ..... 118/7, 9, 646, 658; 222/DIG. 1; 427/8, 18

[56] References Cited

U.S. PATENT DOCUMENTS

| | | | |
|---|---|---|---|
| 3,152,924 | 10/1964 | Wanielista et al. | 118/658 |
| 3,802,381 | 4/1974 | O'Neill et al. | 118/646 |
| 3,822,139 | 7/1974 | Westdale | 118/658 |
| 3,892,672 | 7/1975 | Gawnon | 118/646 |
| 3,893,408 | 7/1975 | Lamel | 118/646 |
| 3,932,034 | 1/1976 | Takahashi | 118/646 |

*Primary Examiner*—Mervin Stein
*Assistant Examiner*—Andrew M. Falik
*Attorney, Agent, or Firm*—McGlew and Tuttle

[57] ABSTRACT

An apparatus for controlling the toner concentration of a dry developer, including a magnetic carrier and a non-magnetic toner, used in a magnetic brush developing system. In view of that the system includes an inherent magnetic means and an inherent circulation path through a portion of which a steady stream of the developer is established during its operation, a means such as a Hall element is set at a position near to the steady stream portion of the developer and in the atmosphere for detecting the magnitude of a leakage magnetic flux from the portion which is emanated from said magnetic means to determine the value of toner concentration of the developer in the system through analyzing. Thereupon, a supply of toner to the system is automatically controlled based on the determined value.

5 Claims, 5 Drawing Figures

APPARATUS FOR CONTROLLING THE TONER CONCENTRATION OF A DEVELOPER USED IN A DRY TYPE DEVELOPING SYSTEM

This is a continuation of application Ser. No. 587,660 filed June 17, 1975, now abandoned.

BACKGROUND OF THE INVENTION

The invention relates to a method and an apparatus for controlling the toner concentration of a dry developer, including a magnetic carrier and a non-magnetic toner, used in a dry type developing system.

In a dry type developing system for example, a magnetic brush developing system, the developer generally comprises a mixture of magnetic carrier and non-magnetic toner, which mixture is magnetically maintained for supply to an electrostatic latent image for converting it into a visual image. When the developer is supplied to the latent image, charged toner particles which adhere to carrier particles is attracted to the latent image by electrostatic interaction while the carrier remains attached to the developer retaining member under the influence of a magnetic force, so that after repeated developing process, only the toner component of the developer will be gradually reduced in quantity .

On the other hand, when converting an electrostatic latent image into a visual image by means of the magnetic brush developing system, it is known that the optimum toner concentration in the developer ranges from 3 to 5% by weight of the toner. Above 5%, the toner may be attrated to non-image areas, thus causing so-called back smearing in the visual image, while below 3%, the optical density of the visual image is reduced, resulting in a poor contrast. Therefore, it is necessary to maintain the toner concentration of the developer within a proper range in order to assure an optimum visual image.

In one technique of controlling the toner concentration, a change in the amount of reflected light from the developer as the proportion of the toner and carrier in the developer changes is utilized by irradiating the developer with light and determining the amount of reflected light therefrom to sense the toner concentration, thereby replenishing the toner so as to maintain a constant toner concentration. However, the described technique involves difficulties in that the light source and the light receiving element which are used for the purpose of photometric determination are liable to be soiled by the toner to result in varying photometric parameters and that a small difference in the reflectivity between the carrier and the toner results in an unsatisfactory sensing accuracy.

An alternative method is also known in which the toner is electrostatically attracted to the surface of an electrode plate to which a fixed voltage of the opposite polarity to that of the toner is applied, or to the surface of a dielectric member which is charged by an electric charge of the opposite polarity to that of the toner, followed by irradiation of the surface with light, and determining a change in the amount of light which has transmitted through or which is reflected from the surface to thereby detect the amount of toner attracted and hence the toner concentration in the developer. When this method is employed, the toner which is attracted to the surface must be wiped away each time the toner concentration is determined, resulting in the difficulty to detect the toner concentration on the continuous bases and in the susceptibility of the detection accuracy to the humidity.

A further alternative is to utilize a change in the apparent magnetic permeability of the developer as the proportion of the magnetic carrier and the non-magnetic toner in the developer varies. Thus, the developer is placed inside a coil to sense a change in the inductance of the coil, which is then converted into a voltage or the like, thereby determining the proportion of the carrier and toner in the developer. However, the device which is required to perform such a determination tends to be expensive. In addition, separate circulation path must be provided for the purpose of sampling independently from the inherent circulation path which is used for the purpose of developing, thus resulting in a complex overall system.

SUMMARY OF THE INVENTION

It is an object of the invention to provide a method and an apparatus for controlling toner concentration in a dry type developing system which overcomes above disadvantages and which is simple in structure and capable of detecting the toner concentration efficiently and continuously with a high detection accuracy.

DETAILED DESCRIPTION OF EMBODIMENT

Figure 1:
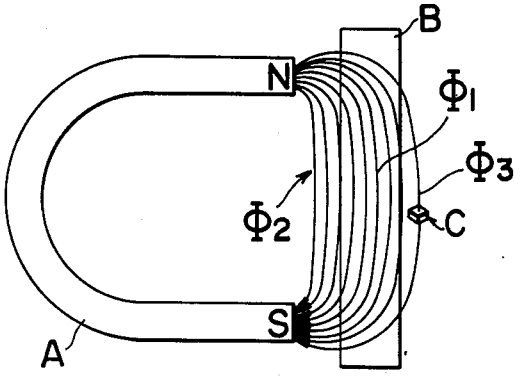
FIG. 1 is a schematic view illustrating the concept of the present invention.

FIG. 1 shows that when a permanent magnet A and a magnetizable body B are disposed in a spaced relationship in the atmosphere to form a magnetic path, the magnetic flux which emanates from the N-pole to the S-pole of the magnet A will essentially comprise a main flux Φ1 which passes through the interior of the magnetizable body B, a first leakage flux Φ2 which does not pass through the body B, and a second lekage flux Φ3 which follows a leakage path after passing through the body B. All of the fluxes Φ1, Φ2 and Φ3 depends on the magnetic reluctance of the magnetizable body B which in turn depends on the magnetic permeability and the configuration thereof.

Thus, by replacing the magnetizable body B by a plurality of magnetizable bodies B1, B2 . . . B*n* (not shown) having the same configuration therewith in a sequential manner and determining the respective leakage flux Φ3 at a given position, for example, in a region C, it is possible to determine the ratio of the magnetic permeability of the magnetizable bodies B1, B2 . . . B*n* relative to that of the magnetizable body B. Generally, there is not a significant difference in the magnetic reluctance between a magnetizable body and the atmosphere, so that the leakage flux Φ3 will have a relatively large magnitude, which is advantageous in facilitating its determination. The magnetic permeability of a developer used in a dry type developing process, for example, the magnetic developing process is determined by the proportion of a magnetic carrier relative to that of non-magnetic toner, so that by regarding the magnetizable bodies B, B1, B2 . . . B*n* having the same configuration as masses of the developer, it is possible to determine the proportions of the carrier and toner in the developer or the relative value of the toner concentration in the developer, by determining the respective leakage fluxes Φ3.

Figure 2:
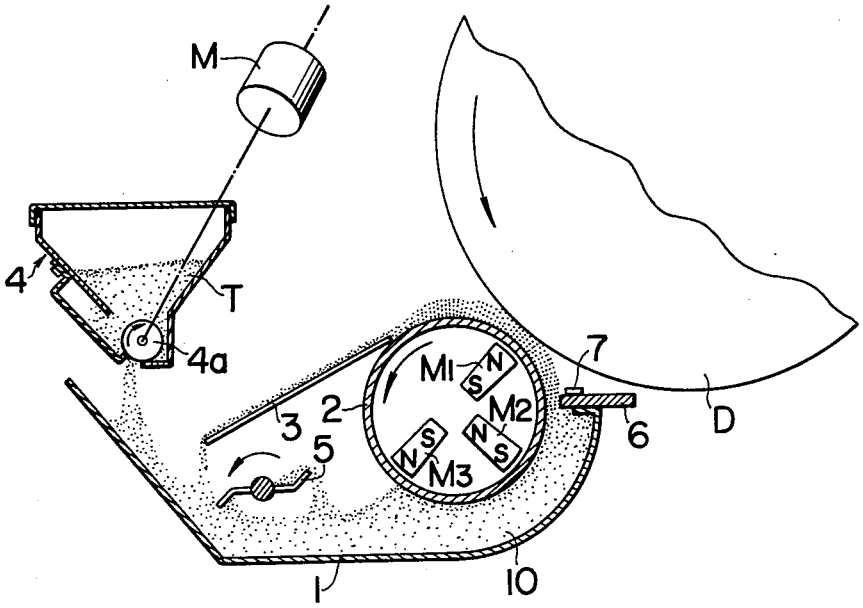
FIG. 2 is a front view of the apparatus constructed in accordance with one embodiment of the invention.

FIG. 2 shows the essential part of the magnetic brush developing apparatus which is constructed in accordance with one embodiment of the invention. The purpose of the apparatus is to convert an electrostatic latent image formed on a photosensitive drum D into a visual image. Specifically, the apparatus comprises a container 1 for containing a supply of developer 10, a plurality of magnets M1, M2 and M3 which are disposed at fixed positions relative to the container 1, a rotatable sleeve 2 of non-magnetic material which surrounds the magnets, a blade 3 for scraping the developer from the surface of the rotary sleeve 2 after its contribution to the developing process, a hopper 4 for retaining a supply of toner T, a stirring member 5, a doctor blade 5 of non-magnetic material, a magnetic detector 7, and a drive motor M.

A developing process by the described magnetic developing system proceeds as follows: The magnets M1, M2 and M3 which are fixed in position establish a stationary magnetic field in space which causes a developer 10 to be attracted to the peripheral surface of the rotary sleeve 2, thereby forming a magnetic brush thereon. As the rotary sleeve 2 rotates in the direction indicated by an arrow in FIG. 2, the magnetic brush of a given height is formed by the doctor blade 6 and is brought into contact with the successive surface regions of the photosensitive drum D which rotates in the same direction, whereby, the toner contained in the developer is attracted by the electric charge which forms an electrostatic latent image, thereby converting the latent image into a visual image on the drum D. As the sleeve 2 further rotates, the developer is scraped off the surface of the rotary sleeve 2 by the blade 3, whereupon it slides down the inclined surface of the blade 3 to the vicinity of the stirring member 5. The stirring member 5 is rotated in the direction indicated by an arrow to urge the developer toward the rotary sleeve 2.

The flux detector 7 is fixedly mounted on top of the doctor blade 6 and in a fixed position relative to the stationary magnets M1, M2 and M3. Because the developer which forms the magnetic brush is shaped to a given configuration on the peripheral surface of the rotary sleeve 2 by means of the doctor blade 6, the relative position of the flux detector 7 with respect to the magnetic brush formed on the rotary sleeve 2 is fixed, so that the determination of the leakage flux from the magnets M1, M2 and M3 which passes through the brush with the aid of the detector 7 permits the toner concentration in the developer supplied to the electrostatic latent image to be sensed. Such determination can be based on calibration data which is established by measuring the leakage flux against a variety of developers of known toner concentration.

Figure 3:
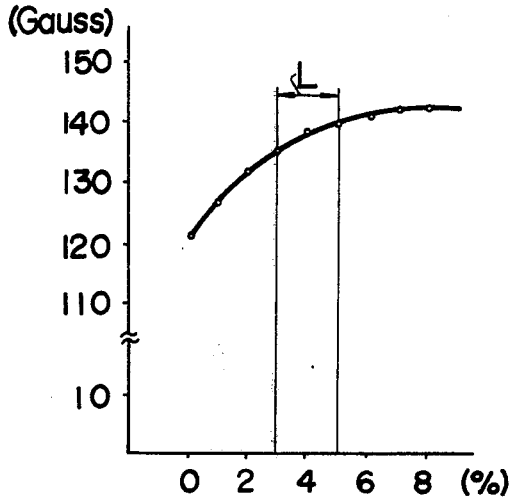
FIG. 3 graphically shows one exemplary characteristic representing the relationship between the toner concentration and the leakage flux in the embodiment shown in FIG. 2.

The curve shown in FIG. 3 illustrates one experimental result representing the relationship between the leakage flux and the toner concentration in the developer. The abscissa represents percentage by weight of the toner in the developer while the ordinate represents the leakage flux as detected by the detector 7 in the units of Gauss. In the graph, the letter L indicates the optimum range of toner concentration.

Figure 4:
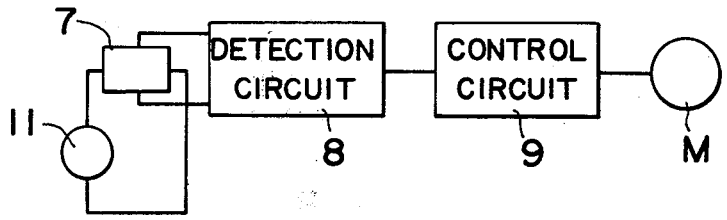
FIG. 4 is a block diagram of a toner concentration control unit which is used in the embodiment shown in FIG. 2.

As indicated in FIG. 4, a flux detector device comprises the flux detector 7 and a detection circuit 8 which feeds a control circuit 9. The control circuit 9 is adapted to control the energization of the drive motor M shown in FIG. 2. When the drive motor M is energized, a rotary valve **4*a* located within the hopper 4 is rotated to supply a quantity of toner contained in the hopper 4 into the container 1 for the purpose of replenishment. The control circuit 9, the drive motor M and the hopper 4** constitute together a toner replenishing device.

The flux detector 7 comprises a Hall element which is supplied with a control current from a stabilized d.c. current source 11 in a direction perpendicular to the magnetic flux. The magnitude of the leakage flux at the location of the detector 7 can be detected by the detection circuit 8 as a Hall voltage $V_H$ which is developed across the detector 7 in a direction perpendicular to that of both the magnetic flux and the control current.

Figure 5:
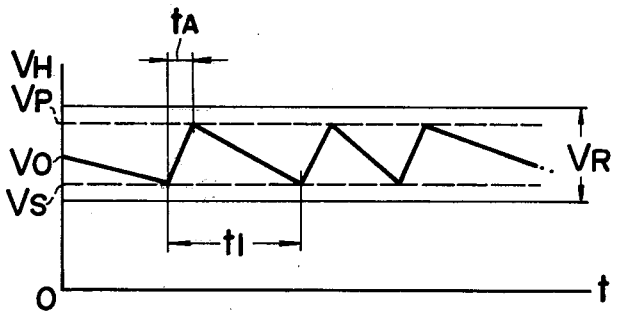
FIG. 5 graphically shows a variation in the output of a magnetic flux detector as the toner content in the developer varies.

As illustrated in FIG. 5, the output of the detector 7 varies within a range $V_R$ which includes a Hall voltage $V_P$ corresponding to the upper limit of the optimum range of toner concentration in the developer, and another Hall voltage $V_S$ corresponding to the lower limit of the range.

Under the initial condition, the toner concentration in the developer is adjusted to a given value, for example, 4%, which corresponds to a Hall voltage $V_O$, as detected by the detection circuit associated with the detector 7. As the developing process proceeds and the toner in the developer is consumed, there results a relative increase in the concentration of the magnetic carrier to increase the magnetic permeability, whereby the leakage flux decreases to cause a reduction in the Hall voltage $V_H$ which is detected by the detection circuit 9. When the Hall voltage $V_H$ decreases below the Hall voltage $V_S$, the output of the detection circuit 8 causes the control circuit 9 to energize the drive motor M. Thereupon the rotary valve **4*a* in the hopper 4 rotates to replenish the toner from the hopper 4 into the container 1. The replenished toner is uniformly stirred in the developer by means of the stirring member 5 and urged toward the rotary sleeve 2. As a result, the toner concentration in the magnetic brush increases to decrease the magnetic permeability of the developer which forms the magnetic brush, thus increasing the leakage flux and hence the Hall voltage $V_H$ as detected by the detection circuit 8. As the toner concentration in the developer increases and the Hall voltage $V_H$ rises above the Hall voltage $V_P$, the output of the detection circuit 8 causes the control circuit 9 to deenergize the drive motor M. This process is repeated during the subsequent developing process. The interval $t_1$ between successive replenishment of the toner varies with the kind of originals to be copied, while the period $t_A$ during which the replenishment is performed remains substantially constant. However, it should be understood that the period of replenishment can be changed by the suitable design of the replenishing device. The level $V_P$ inherently depends on the hysterisis characteristic of the detection circuit 8**. In this manner, the toner concentration in the developer can be maintained in the optimum range.

It should be understood that the leakage flux can be detected by other means than the Hall element, such as a magnetic reluctance element, a magnetically sensitive diode or the like.

What is claimed is:

1. An apparatus for controlling the toner concentration of a dry toner in a copying device using a drum having an electrostatic latent image thereon comprising; a dry developer container, a dry developer in said container including a magnetic carrier and a non-magnetic toner, magnetic field producing means for picking up developer with toner from the container and establishing a stationary magnetic field in respect to said container, a rotatable sleeve of non-magnetic material arranged over said stationary magnetic field spaced from the drum and being rotatable to pick up a portion of the toner and carrier supply so as to form a magnetic brush on its surface to be brought into contract with the electrostatic latent image on the drum, a doctor blade having an edge disposed in spaced relationship to said sleeve and contacting and deflecting a portion of the thickness of said magnetic brush so as to retain a remaining magnetic brush of a lesser predetermined thickness and to shape said magnetic brush which has been retained on the surface of said sleeve, a magnetic leakage flux detector means disposed on said blade in a position to detect the magnitude of the leakage flux to the atmosphere adjacent said brush immediately before said brush is brought into contact with the electrostatic latent image on the drum with said leakage flux being generated by said magnetic field producing means, said leakage flux magnitude being proportional to the toner concentration in said brush, supply means in said container for supplying toner to replenish the toner concentration in said developer, and control means connected to said supply means and said detector means to regulate said supply means to suppply toner to said container in quantities to maintain a selected leakage flux magnitude adjacent said magnetic brush immediately before said brush comes into contact with the latent image on the drum.

2. An apparatus according to claim 1, wherein said magnetic field producing means comprises a plurality of magnets disposed at fixed positions relative to said container and including scraping means for scraping said magnetic brush off said rotatable non-magnetic sleeve spaced from said doctor blade and from the position at which said brush contacts the drum.

3. An apparatus according to claim 1, wherein said control means further comprises a detection circuit connected to said leakage flux detector means for receiving an output from said detector means, and a control circuit connected between said detection circuit and said supply means for activating said supply means in response to the output of said detector means to said detection circuit, said detector means further comprising a Hall element which produces a Hall voltage proportional to said leakage flux magnitude which forms said detector means output.

4. An apparatus according to claim 1, wherein said supply means further includes, a hopper for containing said toner supply, a rotary valve means at the bottom of said hopper for directing toner from said hopper to said developer container, and motor means connected to said rotary valve means for rotating it activatable by said control means in response to a reduction in said magnetic flux magnitude detected by said detector means.

5. An apparatus for controlling the toner concentration of a dry toner in a copying device using a drum having an electrostatic latent image thereon comprising; a dry developer container, a dry developer in said container including a magnetic carrier and a non-magnetic toner, magnetic field producing means for picking up developer with toner from the container and establishing a stationary magnetic field in respect to said container, a rotatable sleeve of non-magnetic material arranged over said stationary magnetic field spaced from the drum and being rotatable to pick up a portion of the toner and carrier supply so as to form a magnetic brush on its surface to be brought into contact with the electrostatic latent image on the drum, a doctor blade having an edge disposed in spaced relationship to said sleeve and contacting and deflecting a portion of the thickness of said magnetic brush so as to retain a remaining magnetic brush of a lesser predetermined thickness and to shape said magnetic brush which has been retained on the surface of said sleeve, a magnetic leakage flux detector means disposed adjacent said blade in a position to detect the magnitude of the leakage flux to the atmosphere adjacent said brush immediately before said brush is brought into contact with the electrostatic latent image on the drum with said leakage flux being generated by said magnetic field producing means, said leakage flux magnitude being proportional to the toner concentration in said brush, supply means in said container for supplying toner to replenish the toner concentration in said developer, and control means connected to said supply means and said detector means to regulate said supply means to supply toner to said container in quantities to maintain a selected leakage flux magnitude adjacent said magnetic brush immediately before said brush comes into contact with the latent image on the drum.

* * * * *